US011054763B2

(12) United States Patent
Smith et al.

(10) Patent No.: US 11,054,763 B2
(45) Date of Patent: Jul. 6, 2021

(54) BLADE WITH TAPERED SURFACES TO TRANSPORT PRINT SUBSTANCE

(71) Applicant: HEWLETT-PACKARD DEVELOPMENT COMPANY, L.P., Spring, TX (US)

(72) Inventors: Kenneth K. Smith, Boise, ID (US); Jeff Luke, Boise, ID (US); Mathew Lavigne, Boise, ID (US); Dean Richtsmeier, Boise, ID (US)

(73) Assignee: HEWLETT-PACKARD DEVELOPMENT COMPANY, L. P., Spring, TX (US)

( * ) Notice: Subject to any disclaimer, the term of this patent is extended or adjusted under 35 U.S.C. 154(b) by 0 days.

(21) Appl. No.: 16/964,393

(22) PCT Filed: May 18, 2018

(86) PCT No.: PCT/US2018/033461

§ 371 (c)(1),
(2) Date: Jul. 23, 2020

(87) PCT Pub. No.: WO2019/221750

PCT Pub. Date: Nov. 21, 2019

(65) Prior Publication Data

US 2021/0048764 A1 Feb. 18, 2021

(51) Int. Cl.
*G03G 15/08* (2006.01)
*B41J 11/00* (2006.01)

(52) U.S. Cl.
CPC ..... *G03G 15/0865* (2013.01); *G03G 15/0812* (2013.01); *B41J 11/0045* (2013.01)

(58) Field of Classification Search
CPC ..... G03G 15/0822; G03G 15/0865; G03G 15/0887; G03G 15/0889; G03G 15/0891
USPC ..... 399/254, 255, 256, 258, 263
See application file for complete search history.

(56) References Cited

U.S. PATENT DOCUMENTS

| | | | | |
|---|---|---|---|---|
| 4,461,210 | A | 7/1984 | MacPhee et al. | |
| 5,857,134 | A * | 1/1999 | Ahn | G03G 15/0822 399/256 |
| 6,128,453 | A | 10/2000 | Ban et al. | |
| 8,200,128 | B2 | 6/2012 | Oda | |
| 8,208,839 | B2 | 6/2012 | Mase et al. | |
| 8,340,556 | B2 | 12/2012 | Kunihiro et al. | |
| 8,660,469 | B2 | 2/2014 | Carter, II et al. | |
| 9,360,796 | B2 | 6/2016 | Leemhuis | |
| 2007/0264051 | A1 | 11/2007 | Tanaka | |
| 2008/0205939 | A1 | 8/2008 | Mase | |
| 2008/0260441 | A1 | 10/2008 | Takagi | |

FOREIGN PATENT DOCUMENTS

| | | |
|---|---|---|
| EP | 2211237 A3 | 4/2011 |
| JP | 3980836 B2 | 9/2007 |

* cited by examiner

*Primary Examiner* — William J Royer
(74) *Attorney, Agent, or Firm* — Staas & Halsey LLP

(57) ABSTRACT

Example implementations relate to shafts with blades with tapered surfaces consistent with the disclosure. For example, a device including a shaft, a blade with a plurality of tapered surfaces, the surfaces tapered from a center of the shaft to an outer edge of the shaft, and a membrane attached to the plurality of tapered surfaces to facilitate print substance transport from the center of a print substance container towards the edges of the print substance container.

15 Claims, 6 Drawing Sheets

BLADE WITH TAPERED SURFACES TO TRANSPORT PRINT SUBSTANCE

CROSS REFERENCE TO RELATED APPLICATIONS

This application is a U.S. National Stage Application which claims the benefit under 35 U.S.C. § 371 of International Patent Application No. PCT/US2018/033461 filed on May 18, 2018, the contents of which are incorporated herein by reference.

BACKGROUND

Print substance containers or cartridges hold print substance for printing. A laser is used to discharge a latent image of a printed page onto an organic photoconductor (OPC) surface. Print substance is transferred from the surface of the OPC to paper and/or other print materials to print images.

DETAILED DESCRIPTION

Figure 1:
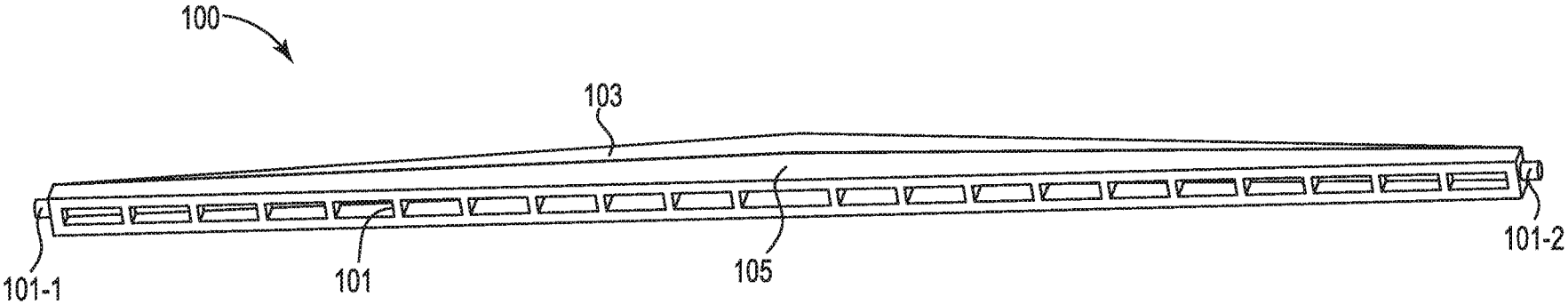
FIG. 1 illustrates an example of a device including a shaft, a blade with tapered surfaces, and a membrane attached to the blade according to the disclosure.

Devices and methods of a shaft with tapered blades deployed in a print substance container are described herein. A shaft with blades keep the print substance aerated and flowing freely inside the print substance containers during printing.

In some examples, a shaft can include a blade to facilitate rotations and transport print substance from one area to a different area of a print system. As used herein, the term "print system" refers to a system that schedules, queues and spools printer output from an application to the printer. As used herein, the term, "print substance container", refers to a component of a print system that holds spool of photographic film, a quantity of ink, and/or other print substances. As used herein, the term, "print substance" refers to toners and/or similar substances. A print system recreates a digital image by depositing droplets of print substance onto paper, plastic, or other substrates. A print system also produces images by an electrophotographic (EP) process to attach and adhere toner particles onto a print medium, such as a sheet of paper.

A print system can produce images by an electrophotographic (EP) process to attach and adhere toner particles onto a print medium, such as a sheet of paper. A print system can include a laser beam and an OPC drum. Text and/or graphics is produced as the laser beam travels back and forth and shines on the OPC drum. The OPC drum, also known as an imaging drum, is a thin-walled aluminum cylinder, coated with pigmented photoconductive substances. While activated, the laser beam shines the OPC and discharges a latent image of the digital image onto the OPC surface which can be printed on print material.

The laser beam of a print system has to maintain clearance from print substance, and maintain a line-of-site to the full width of the OPC for EP process to attach and adhere toner and/or print substance particles onto a print medium. In some examples, laser beam's-line-of-site refers to the path which facilitates the laser beam to shine on the OPC to facilitate printing images on print material. The laser beam can shine between a first print substance container and a second print substance container. In some examples, the first print substance container can obstruct the laser beam's clear line-of-site. In some examples, the first print substance container can attach to the full length of the second print substance container and can block the laser beam's path, obstructing the laser beam from shining on the OPC and hinder printing images on print material.

Accordingly, the disclosure is directed to shafts with tapered blades. For example, a shaft with tapered blades deployed in a first print substance container can be utilized to transport print substance towards a position within a first print substance container to facilitate the laser beam to remain unobstructed and shine on the OPC. In some examples, the blade mounted on the shaft can taper from the center of the shaft towards the end of the first print substance container at an angle to move print substance towards the end of the first print substance container. In some examples, additional channels can be coupled to the first print substance container to facilitate transfer of the print substance from the first container to a second print substance container.

The print substance from the first print substance container can be transported to each end of the first print substance container. Print substance from the ends and/or edges of the first print substance container can be transported to the second print substance container. Transporting print substance to the edges of the print substance container can reduce the amount of print substance stranded in the print substance container, and shield the laser beam from being blocked. Stranded print substance refers to print substance that remains unused and/or abandoned in the print substance container without being transported to other print substance containers, and/or used by the print system.

FIG. 1 illustrates an example of a device 100 including a shaft 101, a blade 103 with tapered surfaces, a membrane 105 attached to the blade according to the disclosure. As illustrated in FIG. 1, shaft 101 of device 100 can include extended portions 101-1 and 101-2. In some examples, device 100 can rotate and transport print substance from one print substance container to a different print system container in a print system.

In some examples, device 100 can transport print substance towards the edges of the print substance container by using blade 103, as described herein. For example, shaft 101 can activate blade 103 and move print substance towards the edges of the print substance container. Moving print substance towards the edges of the print substance container can facilitate effective movement of print substance from one print substance container to another print substance container and keep a laser beam within the print system unblocked, as described herein. In some examples, device 100 is perpendicular to the surface of a print system. While activated, device 100 can move in a first direction followed by moving to a second direction, opposite to the first direction, to rotate, and transport print substance towards the edges of the print substance container.

As described herein, device 100 includes shaft 101. Shaft 101 can include two surfaces. In some examples, shaft 101 can include a solid surface on one side and a cored surface on a second side. In some examples, shaft 101 can include cored surfaces on both sides of the surfaces. The cored surface of shaft 101 can facilitate uniform wall thickness of shaft 101 to rotate and transport print substance uniformly. Shaft 101 can be made of thermoplastic, among other materials. Shaft 101 can have blade 103 mounted on it. In some examples, shaft 101 can include two extended portions 101-1 and 101-2 at each end of shaft 101. Extended portions 101-1 and 101-2 can couple shaft 101 to a print substance container.

As described herein, device 100 includes blade 103. Blade 103 includes a plurality of tapered surfaces. As described herein, "tapered surfaces" refers to the surface of a blade and/or other object, that gradually gets thinner toward an end. The plurality of tapered surfaces of blade 103 makes shaft 101 more aerodynamic and facilitates in faster print substance transport. In some examples, the plurality of tapered surfaces of blade 103 is wider around the center of shaft 101 and gradually thins out towards the edges of shaft 101. In some examples, the tapered surfaces of blade 103 are tapered from a center of shaft 101 to an outer edge of shaft 101. Blade 103 mounted on shaft 101 can move print substance towards the end of a first print substance container at an angle to move print substance towards the edges of the print substance container, as described herein.

In some examples, blade 103 of device 100 can be mounted on shaft 101 by using adhesive material. For example, an adhesive layer of a double-sided tape can hold one surface of blade 103 on one side, and one surface of shaft 101 on the opposite side to mount blade 103 and shaft 101 together. In some examples, blade 103 can be attached to the plurality of tapered surfaces by heat staking. Heat staking process uses heat and pressure to reform the thermoplastic of shaft 101 to the many shapes and/or profiles of plurality of tapered surfaces of blade 103. In response to receiving heat, shaft 101 reforms, and blade 103 attaches to shaft 101. As blade 103 attaches to shaft 101 a bond is created that uses thermoplastic's inherent strength to keep the finished assembly of blade 103 and shaft 101 intact.

As described herein, device 100 includes a membrane 105. Membrane 105 is attached to the plurality of tapered surfaces of blade 103. In some examples, membrane 105 can be mechanically attached to the plurality of tapered surfaces of blade 103. In some examples, membrane 105 can be attached to the plurality of tapered surfaces via adhesive materials (e.g., glue, double sided tape, heat staking etc.). In some examples, membrane 105 can be attached to the plurality of tapered surfaces by a heat staking process. Using the heat staking process, an intact bond can be created between membrane 105 and blade 103.

In some examples, membrane 105 is shaped to be received by the plurality of the tapered surfaces of blade 103. For example, membrane 105 can be shaped wide to adhere to the wider surfaces of blade 103 that is closer to the center of shaft 101. As used herein, the term "wide" refers a diameter of the surface that is more than the diameter of the average surfaces of a blade. In some examples, membrane 105 can be shaped narrow to adhere to the thin side of blade 103 that is out towards the edges of shaft 101. As used herein, the term "narrow" refers to a diameter that is less than the diameter of the average surfaces of a blade. Membrane 105 can be cut into corresponding shapes of tapered surfaces prior to being received by the plurality of the tapered surfaces of blade 103. For example, membrane 105 can be cut in advance into narrow shapes to correspond to the thin side of blade 103 prior to being received by the tapered surfaces of blade 103. Membrane 105 can be shaped to correspond to the tapered surfaces of blade 103 during the heat staking process.

Device 100, as described herein, can transport print substance towards the edges of the print substance container by using tapered blade 103. Device 100 can move print substance towards the end of a first print substance container at an angle to move print substance towards the edges of the first print substance container, and facilitate increased print substance transportation to other print substance containers of the print system. In some examples, the first print substance container can have channels on each side to transfer the print substance moved by the device 100. In some examples, device 100 can reduce the amount of stranded print substance in the print substance container, and facilitate print substance usage in a print system.

Figure 2:
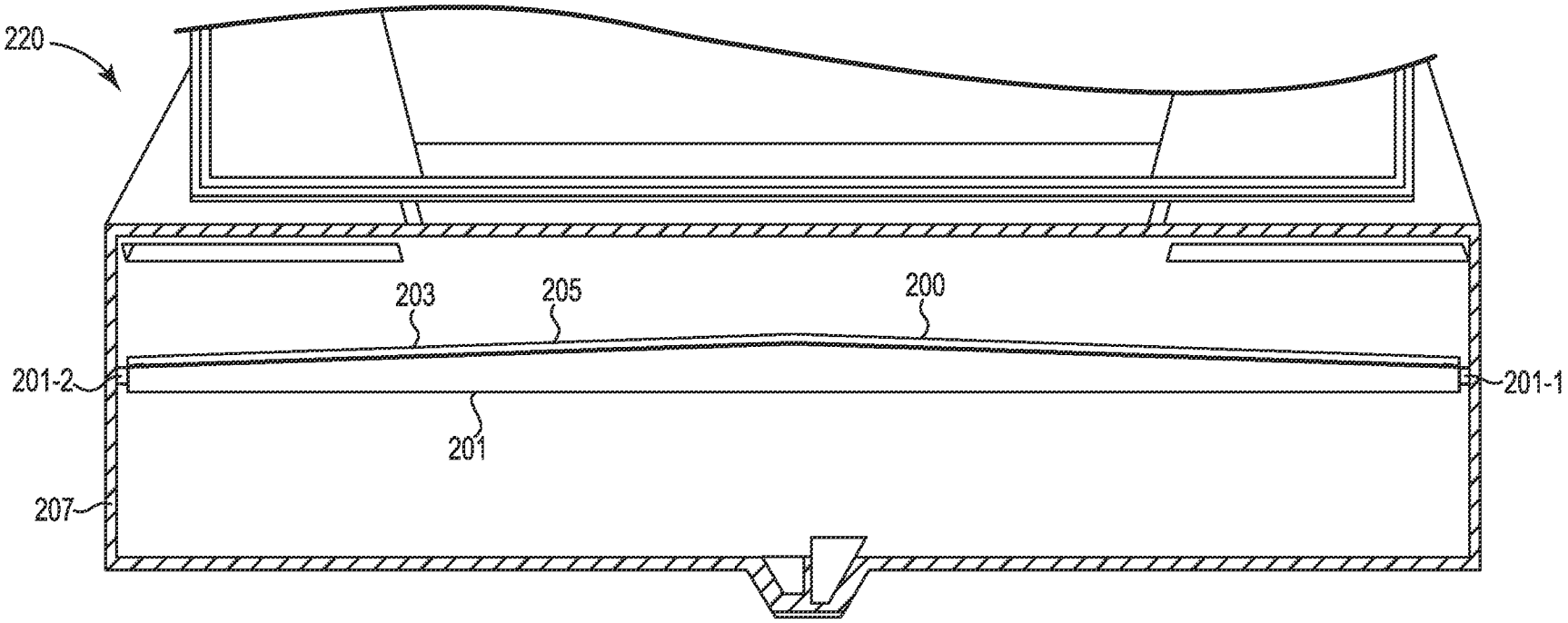
FIG. 2 illustrates an example of a system according to the disclosure.

FIG. 2 illustrates an example of a system 220 according to the disclosure. As illustrated in FIG. 2, system 220 can include print substance container 207, and device 200. Device 200 is analogous to device 100, as described in FIG. 1. Device 200 includes shaft 201, a blade 203 with tapered surfaces, and a membrane 205 attached to blade 203. Shaft 201 of device 200 can include extended portions 201-1 and 201-2 attached to the print substance container 207. Device 200 can be deployed in print substance container 207. As used herein, the term "deployed" refers to arranging a device, for example device 200, inside a print substance container. The print substance container can be a printer ink cartridge, a toner cartridge, among other containers that hold spool of photographic film, a quantity of ink, and/or other print substances. Device 200 can be deployed in print substance container 207 by coupling shaft 201 to print substance container 207. Device 200 can be deployed in print substance 207 by attaching shaft 201 to print substance 207 via a bushing process.

Extended portions 201-1 and 201-2 of shaft 201 can couple device 200 to print substance container 207. In some examples, print substance container 207 can have apertures on each side to receive extended portions 201-1 and 201-2 of shaft 201 to couple device 200. In some examples, extended portions 201-1 and 201-2 couple with print substance container 207 via bushing. Bushing provides an interface between device 200 and print substance container 207. In some examples, bushing can act as a buffer to absorb some of the energy and/or vibration of device 200, and reduce vibration of shaft 201.

In some examples, extended portion 201-1 can be connected to a gear that is driven by a motor. The extended portion connected to the gear can receive signal from the motor to activate shaft 201. As shaft 201 activates, device 200 activates, and print substance is moved towards the edges of the print substance container 207 using tapered surfaces of blade 203. In some examples, print substance container 207 can include a first channel and a second channel located at the edges the of print substance container 207, as described in FIG. 4.

In some examples, the first channel and the second channel of print substance container 207 can transport print substance from print substance container 207 to a second print substance container. Transporting print substance via the first channel and the second channel can reduce the amount of print substance stranded in print substance container 207, and shield the laser beam from being blocked, as described herein. Additionally, blade 203 can facilitate transporting print substance to the edges of the print substance container 207, instead of the length of the print substance container, and shield the laser beam.

Figure 3:
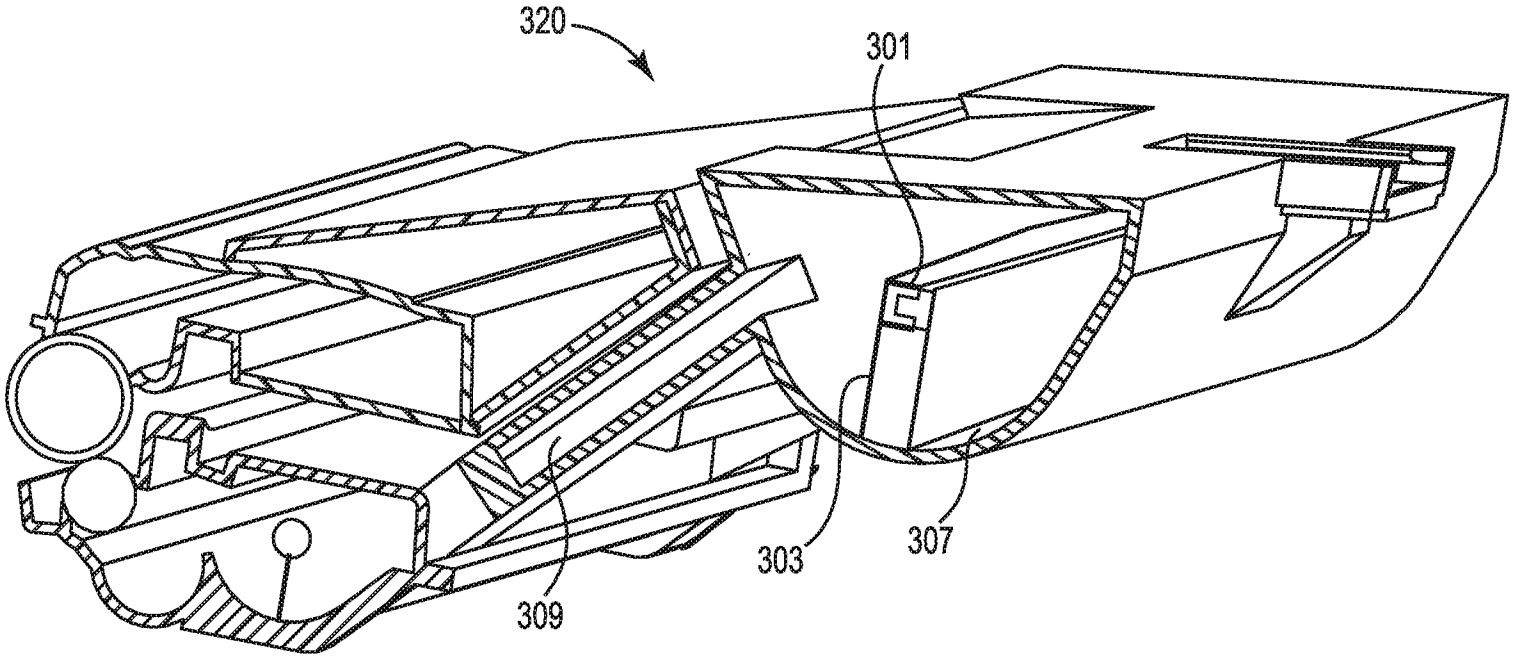
FIG. 3 illustrates an example of a system including a first print substance container, a second print substance container, and a shaft according to the disclosure.

FIG. 3 illustrates an example of a system 320 including a first print substance container 307, a second print substance container 309, and a shaft 301 according to the disclosure. As illustrated in FIG. 3, shaft 301 can include a blade 303 with a plurality of tapered surfaces, as described in FIG. 1. Shaft 301 of system 320 can rotate print substance in the first print substance container 307. The plurality of tapered surfaces of blade 303, coupled with shaft 301, can transport the print substance to the second print substance container 309. Shaft 301 can facilitate transporting print substance towards the edges of print substance container 307 using the tapered surfaces of blade 309. As described herein, system 320 can shield a laser beam of a print system from being blocked by print substance.

In some examples, first print substance container 307 can be a first print substance input container. Print substance (e.g., toner) is stored in first print substance container 307. As first print substance container 307 remains at a rest position between prints, print substance settles in first print substance container 307. Shaft 301 is deployed in first print substance container 307. Shaft 301 can be activated by a controller and/or a computing device providing "print" instruction from the print system. As shaft 301 is activated, the initially settled print substance in first print substance container 307 is rotated, lifted, and transported towards the edges of first print substance container 307. In some examples, first print substance container 307 includes a first channel and a second channel, as described in FIG. 4. The first channel and the second channel can transport print substance from first print substance container 307 to second print substance container 309. In some examples, a laser beam can access a site between the first channel and the second channel of first print substance container 307.

In some examples, the second print substance container 309 can be a secondary print substance input container. Print substance transported from first print substance container 307 can be stored temporarily in second print substance container 309. In some examples, as print substance is transported to second print substance container 309, the laser beam can access the gap between first print substance container 307 and second print substance container 309. The laser beam can shine on the OPC and discharge a latent image of the digital image onto the charged OPC surface.

In some examples, first print substance container 307 can be coupled to second print substance container 309 using adhesive materials (e.g. doubled-sided tape). In some examples, first print substance container 307 can be molded to second print substance container 309 to reduce the gap between the two containers. Reduced gap between first print substance container 307 and second print substance container 309 can limit the amount of unused, stranded print substance in the first print substance container, and/or the second print substance container.

Figure 4:
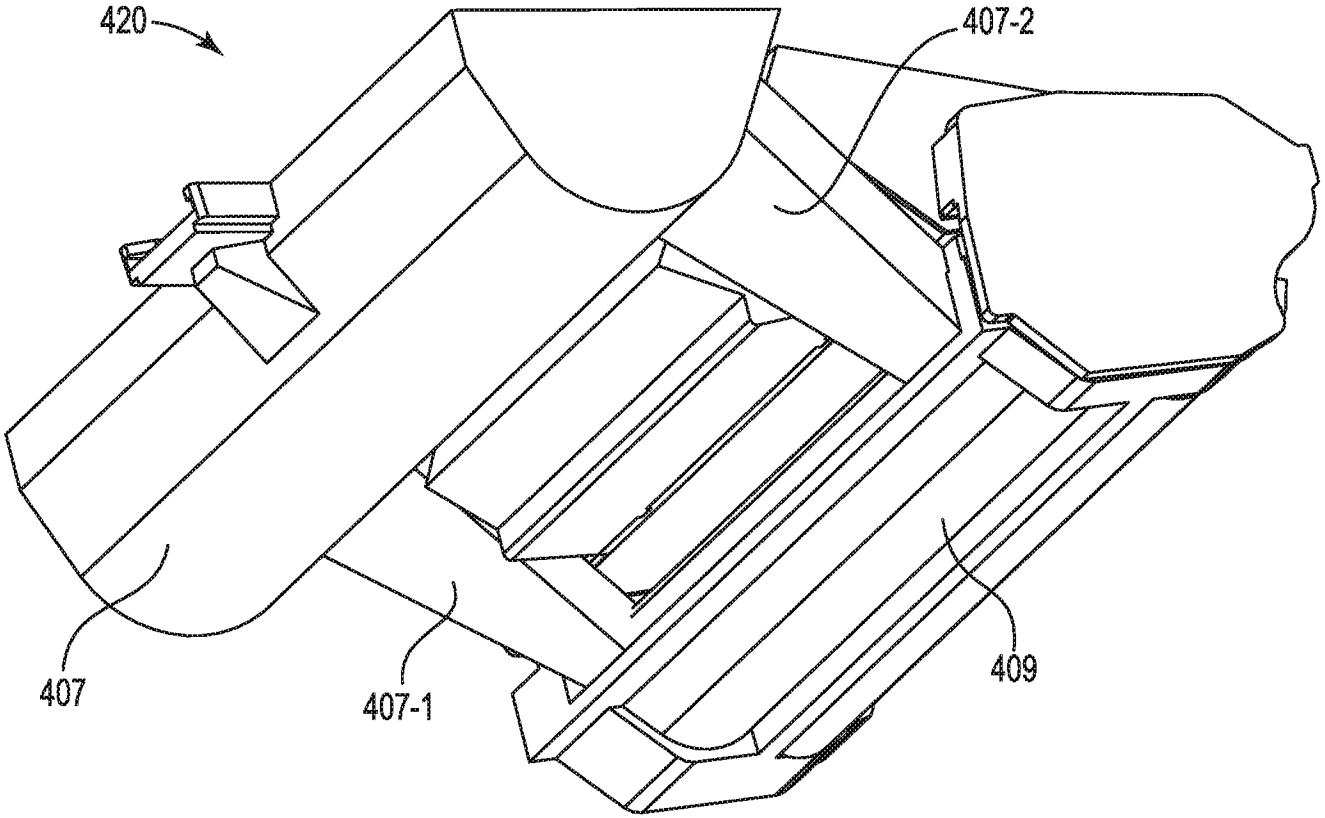
FIG. 4 illustrates a side view example of a system including a first print substance container, and a second print substance container according to the disclosure.

In some examples, first print substance container 307 can be at a raised plane from second print substance container 309. The raised first print substance container 307 facilitates transporting print substance to second print substance container 309. As described herein, first print substance container 307 transports print substance via a first channel and a second channel. The first channel and the second channel are sloping chutes which transports print substance to second print substance container 309, located at a lower plane with respect to first print substance container 307. In some examples, the gap between the first print substance container 307, and the second print substance container 309 provides a site for the laser beam to shine to the OPC, as illustrated in FIG. 4. As print substance transports to the first and the second channels of first print substance container 307, print substance reaches the second print substance container 309 without blocking the site for the laser beam to shine.

As described herein, shaft 301 of system 320 includes a blade 303 with a plurality of tapered surfaces. As described herein, the plurality of tapered surfaces of blade 303 can make shaft 301 more aerodynamic and facilitate in faster print substance transport towards the first channel and second channel of first print substance container 307 compared to blades with parallel and/or non-tapered surfaces. In some examples, blade 303 of shaft 301 can taper from the center of shaft 301 towards an outer edge of shaft 301. For instance, blade 303 can have surfaces that are wider in diameter at the center of shaft 301 which can gradually decrease in diameter as approaching the edges of shaft 301. The tapered design of the shaft can reduce dragging print substance in first print substance container 307. For example, using the plurality of tapered surfaces of blade 303, shaft 301 can transport print substance at an angle to move print substance towards the first and the second channels of first print substance container 307.

FIG. 4 illustrates a side view example of a system 420 including a first print substance container 407 and a second print substance container 409. System 440 is analogous to system 320, as described in FIG. 3. System 420 includes a shaft with a blade that includes a plurality of tapered surfaces deployed in first print substance container 407, as described in FIG. 3. First print substance container 407 includes a first channel 407-1 and a second channel 407-2.

In some examples, first print substance container 407 can include a first channel 407-1 and a second channel 407-2. The first channel 407-1 and the second channel 407-2 can transport print substance from first print substance container 407 to second print substance container 409. In some examples, the first channel 407-1 and the second channel 407-2 are sloping chutes which can transports print substance to second print substance container 409 more effectively. In some examples, the gap between the first print substance container 407, and the second print substance container 409 provides a site for the laser beam to shine on the OPC between the first channel 407-1 and second channel 407-2. As the laser beam shines on the OPC it can discharge a latent image of the digital image onto the charged OPC surface.

In some examples, first print substance container 407 can be at a raised plane from second print substance container 409. A shaft with tapered blade, as described in FIG. 1 and FIG. 2 can be deployed in first print substance container 407. As shaft deployed in first print substance container 407 is activated, the initially settled print substance in first print substance container 407 is rotated, lifted, and transported towards the first channel 407-1 and second channel 407-2 of first print substance container 407. The first channel 407-1 and the second channel 407-2 can transport print substance from first print substance container 407 to second print substance container 409. In some examples, a laser beam can shine on a site located between the first print substance container 407, and the second print substance container 409, as illustrated in FIG. 5.

In some examples, the gap between the first print substance container 407, and the second print substance container 409 facilitates the laser beam to shine. As print substance transports via the first channel 407-1 and second channel 407-2 towards the edges of the first print substance container 407 to the second print substance container 409, the print substance remains contained in the edges. As print substance remains contained along the edges, the gap between first print substance container 407 and second print substance container 409 remains print substance free for the laser beam to shine without being shielded with print substance. As the unshielded laser beam shines on the OPC, a latent image of the digital image is discharged onto the OPC surface and images can be printed on print material.

Figure 5:
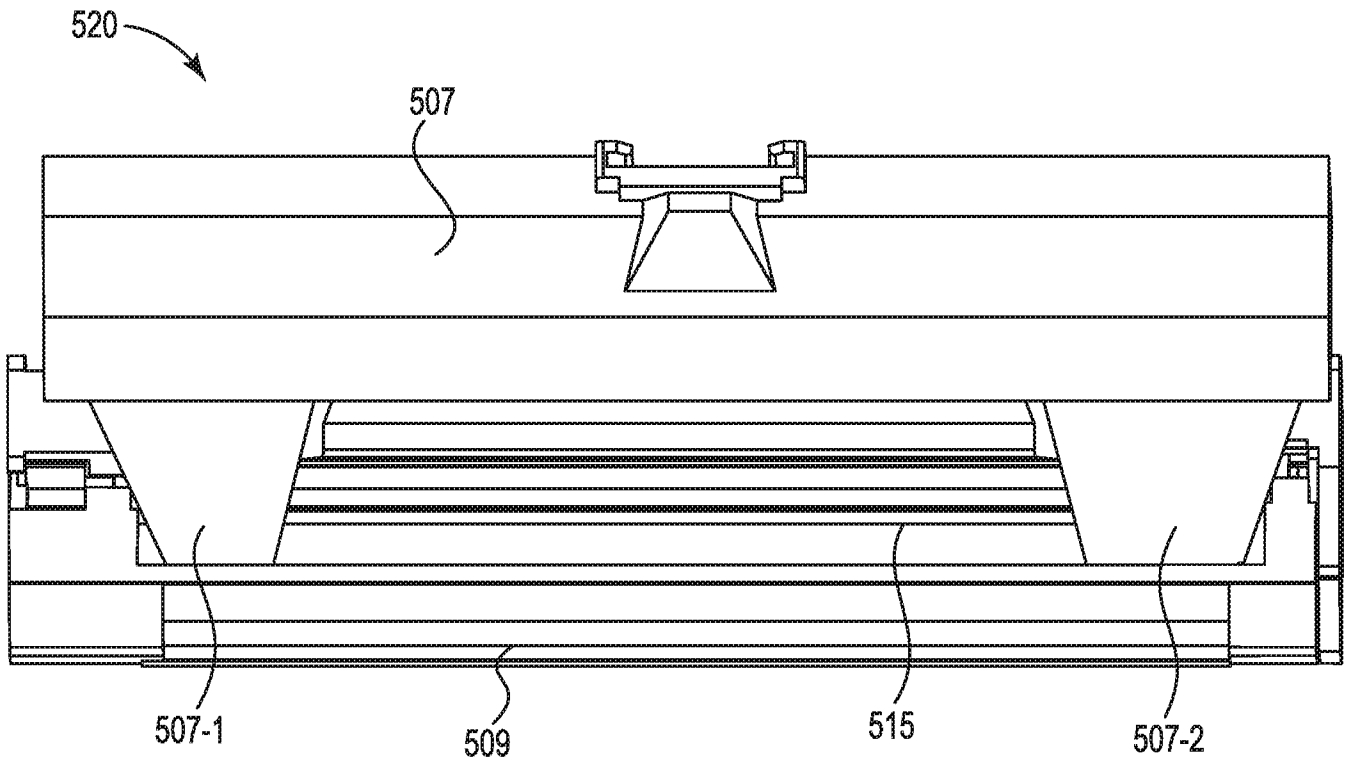
FIG. 5 illustrates an example of a system including a first print substance container, and a second print substance container according to the disclosure.

FIG. 5 illustrates an example of a system 520 including a first print substance container 507, and a second print substance container 509 according to the disclosure. System 520 is analogous to system 320 and system 420, as described in FIG. 3 and FIG. 4. System 520 includes a shaft with a plurality of tapered surfaces on a blade deployed in first print substance container 507, as described in FIG. 3. First print substance container 507 of system 520 includes a first channel 507-1 and a second channel 507-2. System 520 includes a laser beam's site 515.

In some examples, the laser beam site 515 can be located between the first channel 507-1 and the second channel 507-2 of first print substance container 507. In some examples, the first channel 507-1 and the second channel 507-2 are sloping chutes which can transports print substance to second print substance container 509 without blocking the laser beam site 515. As a shaft, analogous to shaft 100 illustrated in FIG. 1, deployed in first print substance container 507 is activated, the initially settled print substance in first print substance container 507 is rotated, lifted, and transported towards the first channel 507-1 and second channel 507-2 of first print substance container 507. The first channel 507-1 and the second channel 507-2 can transport print substance from first print substance container 507 to second print substance container 509. As print substance transports to second print substance container 509, laser beam passing through the laser beam site 515 can shine on the OPC and discharge a latent image of the digital image onto the OPC surface.

In some examples, the gap between the first print substance container 507, and the second print substance container 509 can facilitate laser beam to shine. As print substance transports via the first channel 507-1 and second channel 507-2 towards the edges of the first print substance container 507 to the second print substance container 509, the print substance remains contained in the edges. As print substance remains contained along the edges, the gap between first print substance container 507 and second print substance container 509 remains print substance free for the laser beam to shine without being shielded. As the unshielded laser beam shines on the OPC, a latent image of the digital image is discharged onto the OPC surface which can be printed on print material.

Figure 6:
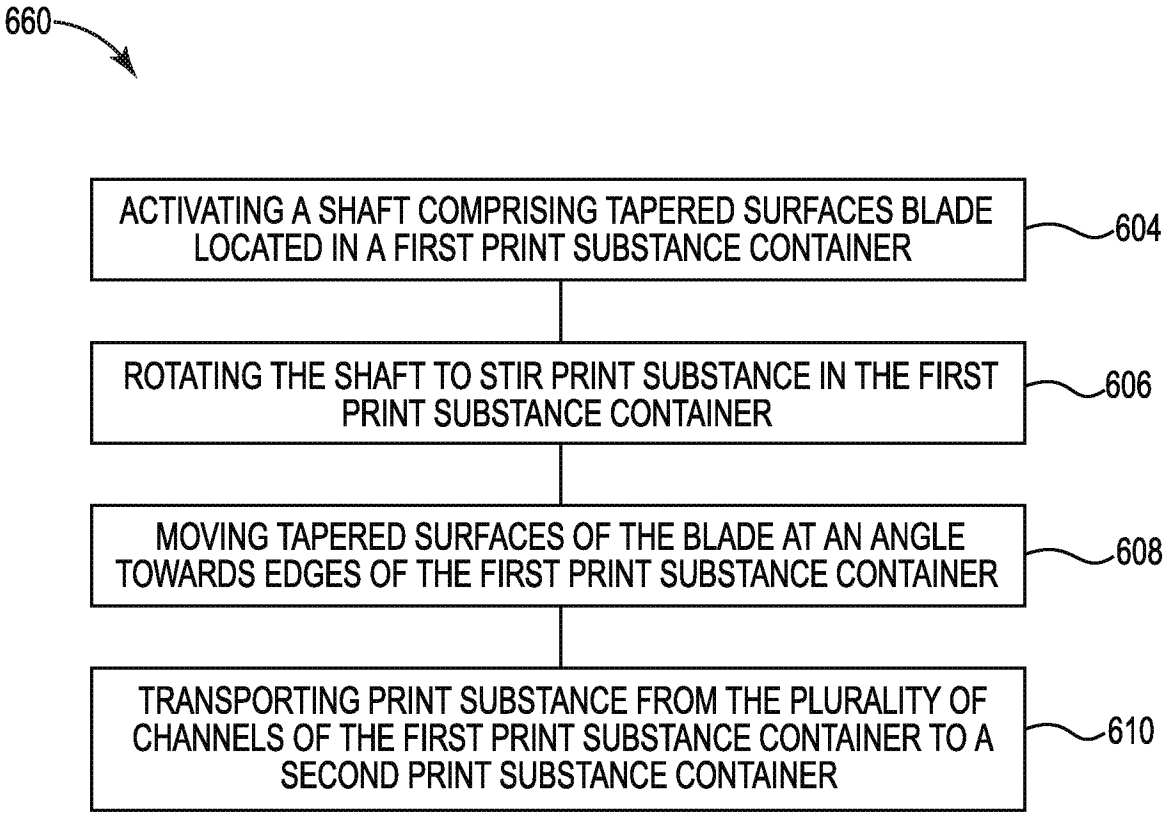
FIG. 6 illustrates an example method for transporting print substance using shafts with tapered blades according to the disclosure.

FIG. 6 illustrates an example method 660 for transporting print substance using a shaft with tapered surfaces on a blade according to the disclosure. In some examples, method 660 can be performed by a system, such as system 320 illustrated in FIG. 3. In some examples, a print system having a computing device and/or controller that includes instructions can be executed to perform the method 660.

At 604, method 660 includes receiving an input to activate a shaft located in a first print substance container. In some examples, the shaft can include a blade with a plurality of tapered surfaces. The shaft and the blade of method 660 can be mounted together. In some examples, the first print substance container can include a plurality of channels. For example, the first print substance container can include a first channel and a second channel. The first channel and the second channel can be sloping chutes located at the edges of the first print substance container. The first channel and the second channel of the first print substance container can transport print substance from the first print substance container to a second print substance container.

At 606, method 660 includes rotating the shaft to stir print substance in the first print substance container. In some examples, the shaft can keep the print substance aerated and flowing freely inside the first print substance container. In some examples, the plurality of tapered surfaces of the blade mounted with the shaft makes the shaft rotate faster, and facilitates in faster print substance transport.

At 608, method 660 includes moving the blade at an angle towards edges of the first print substance container. In some examples, the blade moves the print substance towards the edges of the first print substance container. The plurality of tapered surfaces of the blade can be wider around the center of the shaft, and gradually thin out towards the edges of the shaft. The tapered design of the blade can reduce dragging print substance in first print substance container, and transport print substance towards the edges of the first print substance container. As print substance transports to the edges of the first print substance container, print substance is transported to the plurality of channels of the first print substance container. In some examples, print substance can be transported to a first channel and a second channel of the first print substance container.

At 610, method 660 includes transporting print substance from the plurality of channels of the first print substance container to a second print substance container. In some examples, the plurality of tapered surfaces of the blade mounted on the shaft can transport the print substance to the second print substance container. In some examples, transporting print substance from the first print substance container to the second print substance container via the plurality of channels can shield a laser beam which shines between the first print substance container and the second print substance container. Laser beam in print system can facilitate printing images on a print material.

In some examples, method 660 can prevent the laser beam in a print system to be shield. In some examples, the gap between the first print substance container the second print substance container can facilitate the laser beam to shine. As print substance transports via the first channel and the second channel towards the edges of the first print substance container to the second print substance container, the print substance remains contained in the edges. As print substance remains contained along the edges, the gap between first print substance container and second print substance container remains print substance free for the laser beam to shine without being shielded with print substance. The unshielded laser beam can shine on the OPC, and discharge a latent image of the digital image onto the OPC surface, which can facilitate printing images on a print material.

In some examples, method 660 can transport print substance to the edges of the first print substance container, and reduce the amount of print substance stranded in the first print substance container. With the reduction of stranded print substance in first print substance container, less print substance is wasted.

The figures herein follow a numbering convention in which the first digit corresponds to the drawing figure number and the remaining digits identify an element or component in the drawing. Elements shown in the various figures herein may be capable of being added, exchanged, and/or eliminated so as to provide a number of additional examples of the present disclosure. In addition, the proportion and the relative scale of the elements provided in the figures are intended to illustrate the examples of the present disclosure and should not be taken in a limiting sense.

What is claimed:

1. A device comprising:

a shaft;

a blade with a plurality of tapered surfaces, the surfaces tapered from a center of the shaft to an outer edge of the shaft; and a membrane attached to the plurality of tapered surfaces to facilitate print substance transport from the center of a print substance container towards the edges of the print substance container.

2. The device of claim 1, further comprising the blade mounted on the shaft.

3. The device of claim 1, wherein the shaft further comprises:

a solid surface portion; and a cored portion.

4. The device of claim 1, further comprising the membrane mechanically attached to the plurality of tapered surfaces.

5. The device of claim 1, wherein the membrane is shaped to be received by the plurality of the tapered surfaces of the blade.

6. The device of claim 1, the shaft further comprising two extended portions at each end of the shaft to couple to the print substance container.

7. The device of claim 1, further comprising the blade to couple to the shaft in response to receiving heat.

8. A system comprising:

a first print substance container;

a second print substance container; and a shaft comprising a blade with a plurality of tapered surfaces to:

rotate print substance in the first print substance container; and transport the print substance to the second print substance container.

9. The system of claim 8, further comprising the plurality of tapered surfaces being tapered from a center of the shaft to an outer edge of the shaft.

10. The system of claim 8, wherein the first print substance container includes a first channel and a second channel to transport print substance from the first print substance container to the second print substance container.

11. The system of claim 10, further comprising a laser beam between the first channel and the second channel.

12. The system of claim 8, wherein the first print substance container is coupled to the second print substance container.

13. A method comprising:

activating a shaft located in a first print substance container with a plurality of channels, wherein the shaft includes a blade with a plurality of tapered surfaces;

rotating the shaft to stir print substance in the first print substance container;

moving the tapered surfaces of the blade at an angle towards edges of the first print substance container to transport print substance to the plurality of channels of the first print substance container; and transporting print substance from the plurality of channels of the first print substance container to a second print substance container.

14. The method of claim 13, further comprising transporting print substance from the first print substance container to the second print substance container via the plurality of channels to shield a laser beam, wherein the laser beam shines on a site between the first print substance container and the second print substance container to facilitate printing images on a print material.

15. The method of claim 13, further comprising the blade attaching to the shaft responsive to the shaft stirring the print substance to facilitate transporting the print substance to the plurality of channels of the first print substance container.

* * * * *